United States Patent [19]

Narbaits-Jaureguy et al.

[11] 4,006,447

[45] Feb. 1, 1977

[54] AUDIBILITY-CONTROL SYSTEM FOR RADIO RECEIVER

[75] Inventors: Jean-Raymond Narbaits-Jaureguy; Henri Billottet, both of Paris, France

[73] Assignee: Thomson-CSF, Paris, France

[22] Filed: June 12, 1974

[21] Appl. No.: 478,681

[30] Foreign Application Priority Data

June 14, 1973 France ..... 73.21705

[52] U.S. Cl. ..... 340/33; 343/225

[51] Int. Cl.[2] ..... G08G 1/00

[58] Field of Search ..... 343/225–228; 340/32, 33, 79, 340, 341; 325/51, 466

[56] References Cited

UNITED STATES PATENTS

| | | | |
|---|---|---|---|
| 2,347,477 | 4/1944 | Halstead | 340/32 |
| 2,429,607 | 10/1947 | Capen | 340/32 |
| 2,442,851 | 6/1948 | Halstead | 340/32 |
| 3,098,975 | 7/1963 | Schneiderman | 325/466 |
| 3,144,610 | 8/1964 | Phillips | 343/225 |
| 3,226,601 | 12/1965 | Cramer et al. | 340/341 |
| 3,257,617 | 6/1966 | Goldmark et al. | 325/466 |
| 3,363,250 | 1/1968 | Jacobson | 343/225 |
| 3,400,392 | 9/1968 | Willcox et al. | 343/225 |
| 3,701,024 | 10/1972 | Knowles et al. | 325/51 |
| 3,832,636 | 8/1974 | Kubo | 325/466 |
| 3,876,940 | 4/1975 | Wickford et al. | 325/466 |

*Primary Examiner*—Marshall M. Curtis
*Attorney, Agent, or Firm*—Karl F. Ross; Herbert Dubno

[57] ABSTRACT

A radio receiver, especially one installed in a road vehicle, has a first section for picking up special message signals such as road-traffic information and a second section for picking up a normal radio program. A relay energizable by the special signals, normally connected to the first receiver section, automatically switches a loudspeaker from the second receiver section to the first one whenever such signals begin to arrive. A circuit breaker in series with the relay can be manually controlled by a pushbutton, through the intermediary of a bistable storage circuit, to deactivate the relay for shifting back to audible reproduction of the normal program at the will of the user even while the special message signals continue to arrive; another actuation of the pushbutton in the presence of these signals restores the original condition. Continuing reception of the special message signals, detected by a sensor connected across the circuit breaker, is visually indicated by a luminous display which is continuously illuminated during reproduction of the signals and which flashes during reproduction of the normal program.

19 Claims, 4 Drawing Figures

AUDIBILITY-CONTROL SYSTEM FOR RADIO RECEIVER

FIELD OF THE INVENTION

Our present invention relates to a system for controlling the audibility of a radio receiver, i.e. the acoustic reproduction of incoming electromagnetic signals.

BACKGROUND OF THE INVENTION

Such a system is particularly useful in a moving vehicle passing through an area with traffic problems where information on road conditions or instructions to drivers are broadcast from a control post. Thus it is known to provide automobile radios with automatic changeover means for switching from an entertainment program to special message signals transmitted for the purpose of improving road traffic. The switchover occurs as soon as such message signals are picked up by the vehicular radio receiver, as when the car enters an area within reach of the transmitter at the control post.

If such a vehicle happens to be stationary while receiving the special signals in lieu of the normal radio program, the occupants may become tired or annoyed by a recurrent message (e.g. one played from a magnetic recorder) and may simply decide to turn off the receiver. This leaves the driver unaware of the fact that messages of importance to the progress of the vehicle are still being broadcast.

OBJECTS OF THE INVENTION

An object of our present invention is to provide means in a radio receiver allowing a selective switchover between special messages and a normal radio program while alerting the user, preferably in a non-audible manner which does not interfere with program reception, to the continuing arrival of special message signals.

Another object is to insure that such special message signals are given listening priority, i.e. that they are audibly reproduced upon their initial reception to the exclusion of a normal radio program then in progress, but that the user is free to change back to the normal program even as reception of these signals continues.

SUMMARY OF THE INVENTION

In accordance with our present invention, a radio receiver having a first section for picking up special messages and a second section for picking up a normal radio program includes changeover means with a first and a second section for connecting an electroacoustic transducer with the first and the second receiver section, respectively, and sensing means for detecting the presence of incoming special message signals. In the second position of the changeover means, i.e. during the audible reproduction of the normal radio program, the arrival of the special message signals is revealed by indicator means independent of the electroacoustic transducer, such as a luminous display, controlled by the sensing means.

According to another feature of our invention, the receiver includes signal-responsive switch means for automatically shifting the changeover means from the second position to the first position thereof upon the beginning arrival of special message signals; a manual selector such as a pushbutton, operable to place the changeover means in either of the two aforementioned positions thereof, is effective under the control of the sensing means to shift the changeover means from the first to the second position — in the presence of the special message signals — with temporary deactivation of the signal-responsive switch means.

Pursuant to a further feature of our invention, the sensing means is designed as a voltage comparator — more specifically a NAND gate — bridging a circuit breaker inserted between an output lead of the first receiver section and an extension thereof serving to energize the signal-responsive switch means.

BRIEF DESCRIPTION OF THE DRAWING

The invention with its advantages and features will be better understood in the course of the following description given with reference to the accompanying drawing is which.

SPECIFIC DESCRIPTION

Figure 1:
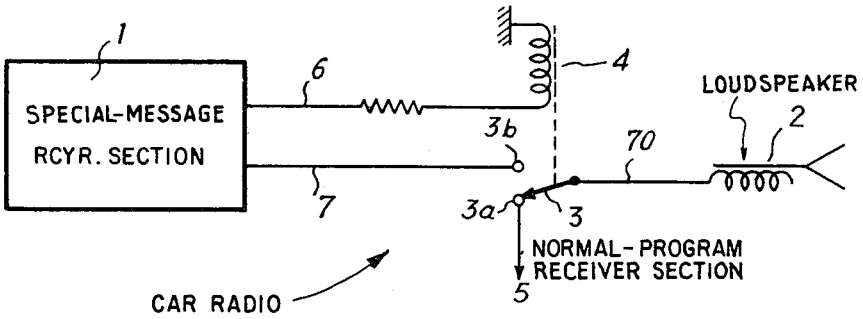
FIG. 1 is a circuit diagram showing part of a car-radio receiver having a section for picking up special messages.

In FIG. 1 we have shown a section 1 and an output circuit 70 of another section 5 of a car-radio receiver driving a loudspeaker 2 via a switch 3 constituted by the armature of a relay 4. The switch 3 when engaging a back contact 3*a*, connects the loudspeaker 2 to the conventional receiver section 5 which picks up entertainment or some other normal radio program; when engaging a front contact 3*b*, it connects the receiver section 1 to the loudspeaker 2 in place of section 5. Relay 4 is connected to receiver section 1 via a conductor 6. As long as no special message signals are picked up by section 1, relay 4 is de-energized and back contact 3*a* is engaged. As soon as such signals are received by section 1 (which need not be described here since its construction is known per se), voltage is applied to conductor 6 and the latter energizes relay 4 which reverses its armature 3 to engage the front contact 3*b*, thus connecting section 1 to loudspeaker 2 which thus gives priority to the audible reproduction of the special messages.

Figure 2:
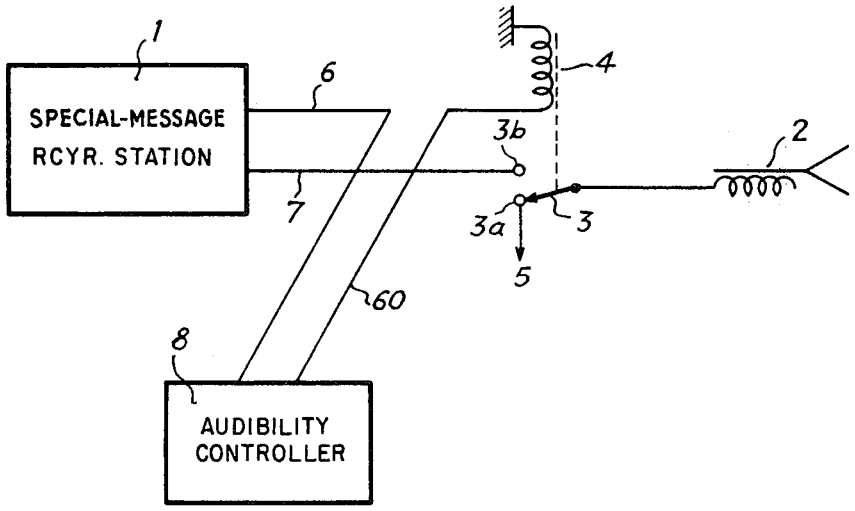
FIG. 2 is a circuit diagram showing an audibility controller according to our invention included in the receiver of FIG. 1.

FIG. 2 shows diagrammatically audibility controller 8 which is manually operated by the user. Controller 8 is inserted in conductor 6 in series with relay 4 for de-energizing same and thus restoring the connection between loudspeaker 2 and receiver section 5.

Figure 3:
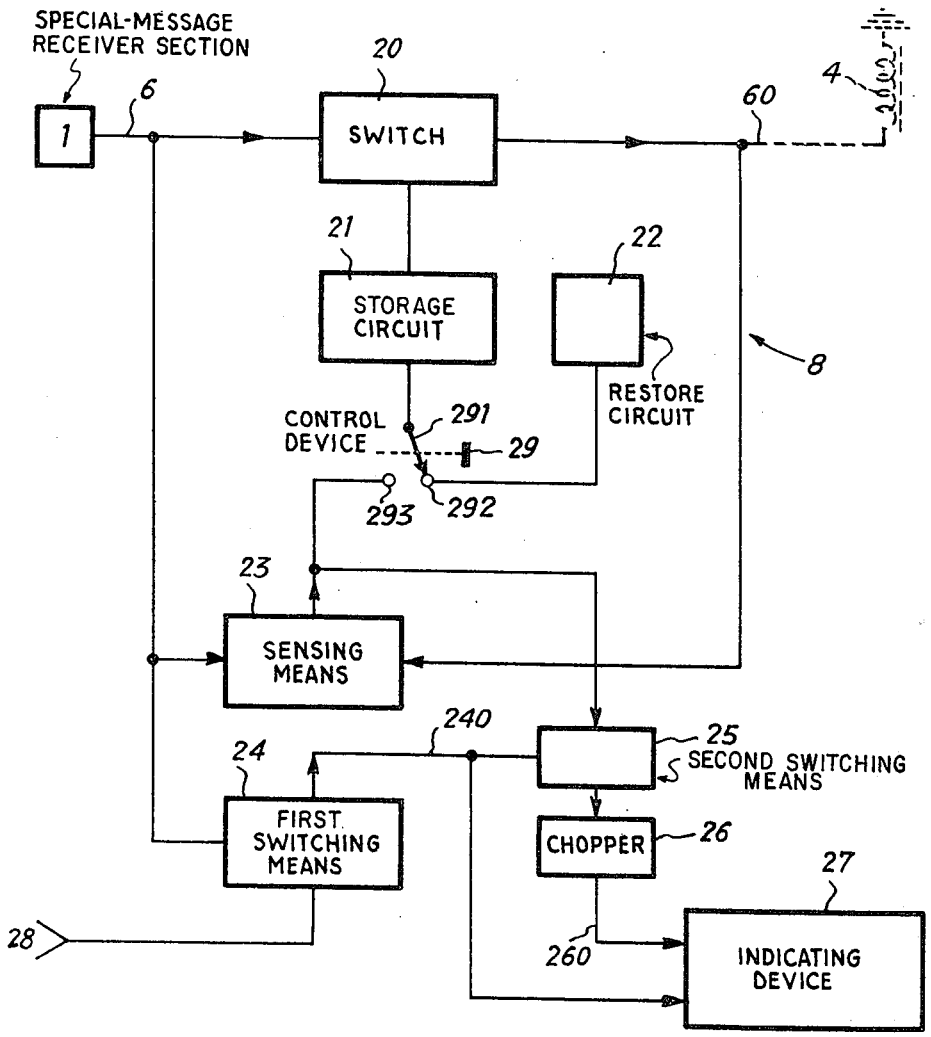
FIG. 3 is a block diagram of the audibility controller of FIG. 2.

As shown in FIG. 3, controller 8 comprises a manual selector in the form of a pushbutton 29 which, when signals are present on conductor 6 from section 1, allows the connection between conductors 6 and 60 to be broken by means of a switch 20, conductor 60 being part of the energizing circuit relay 4.

The pushbutton 29 controls switch 20, acting as a circuit breaker, via a circuit 21 which stores the state of operation of this switch as selected by the user.

A circuit 22 enables the connection between lead 6 and its extension 60 to be restored should receiver section 1 cease to operate during the period of its disconnection from transducer 2, i.e. when the user has placed the changeover switch 3 in the position illustrated in FIGS. 1 and 2. A sensing circuit 23, connected across conductors 6 and 60 in parallel with section 20, allows the state of that switch to be tested by a comparison of their respective voltages. In addition, conductor 6 is connected to a switch 24 (labeled "first switching means") which in the energized condition of this conductor connects a voltage source 28 to be connected to an illuminating device 27 whose operation is modified, when conductors 6 and 60 are disconnected, by another switch 25 (labeled "second switching means") in cascade with a chopping circuit 26, switch 25 being controlled by sensor 23. The purpose of this modification is to produce non-audible information which will attract the user's attention without interfering with normal radio reception and which indicates to him that special messages are continuing to be broadcast and that he can, if he wishes, go back to listening to them as he had done before.

The way in which the system of FIG. 3 operates is as follows: It is assumed that switch 20 is initially closed and receiver section 1 is picking up special message signals. Conductors 6 and 60 are therefore connected to one another, relay 4 is energized, and loudspeaker 2 is audibly reproducing the messages received by section 1. Circuit 23 determines that conductors 6 and 60 are interconnected and contact 293 is at a certain potential $v1$.

If the user decides he no longer wishes to listen to the special signals emitted by receiver section 1, he operates pushbutton 29 and for a brief moment the latter moves an armature 291 thereof, which is connected to storage circuit 21, from a normally engaged contact 292 to an alternate contact 293 which is at potential $v1$. This potential reverses the bistable storage circuit 21, as more fully described below with reference to FIG. 4, so that switch 20 opens and breaks the connection between conductors 6 and 60, thereby deactivating the signal-responsive relay 4 so as to disconnect receiver section 1 from loudspeaker 2. Sensing circuit 23 responds to the resulting alteration in the relative potentials of the two conductors 6, 60 and the potential of contact 293 is changed, going to a value $v2$ which is different from value $v1$. The switch 24, which consists of a relay energized by the signal voltage on lead 6, connects the voltage source 28 to a conductor 240 which causes a luminous array to be lit on a board or display panel 27. The voltage level $v2$ in the output of circuit 23 is such that it closes the switch 25, which may be formed by contacts of a relay excited by that voltage $v2$. Switch 25 thereupon connects the conductor 240 to circuit 26 which produces an intermittent or pulsed current on a conductor 260 for flashing excitation of another luminous array in indicator 27.

It will be noted that the first luminous array is energized as soon as section 1 is operating irrespective of any previous or subsequent actuation of pushbutton 29.

If the user wishes to resume listening to the signals supplied by section 1, he again operates button 29 which connects circuit 21 to contact 293, the latter being now at potential $v2$. This potential re-establishes the previous state of circuit 21 so that it closes switch 20, thus restoring the connection between conductors 6 and 60. The luminous array of indicator 27 directly controlled by switch 24 remains lit, but switch 25 breaks the connection between conductor 240 and the chopper 26 inasmuch as the voltage $v1$ now again present at the output of circuit 23 is not capable of holding switch 25 closed.

It may be that while the special signals are switched out for listening purposes, which is shown by the flashing of one of the arrays of panel 27, they cease to be picked up and section 1 therefore no longer has an output. Under these conditions the previously illuminated panel 27 is extinguished since there is no longer any voltage on contact 293 and since switch 24 is open, thus breaking the connection to the voltage source 28. The resetting circuit 22 then delivers to circuit 21, via contact 292, to a voltage such that the subsequent arrival of special signals from section 1 on conductor 6 recloses the switch 20 which automatically restores the connection between conductors 6 and 60.

Figure 4:
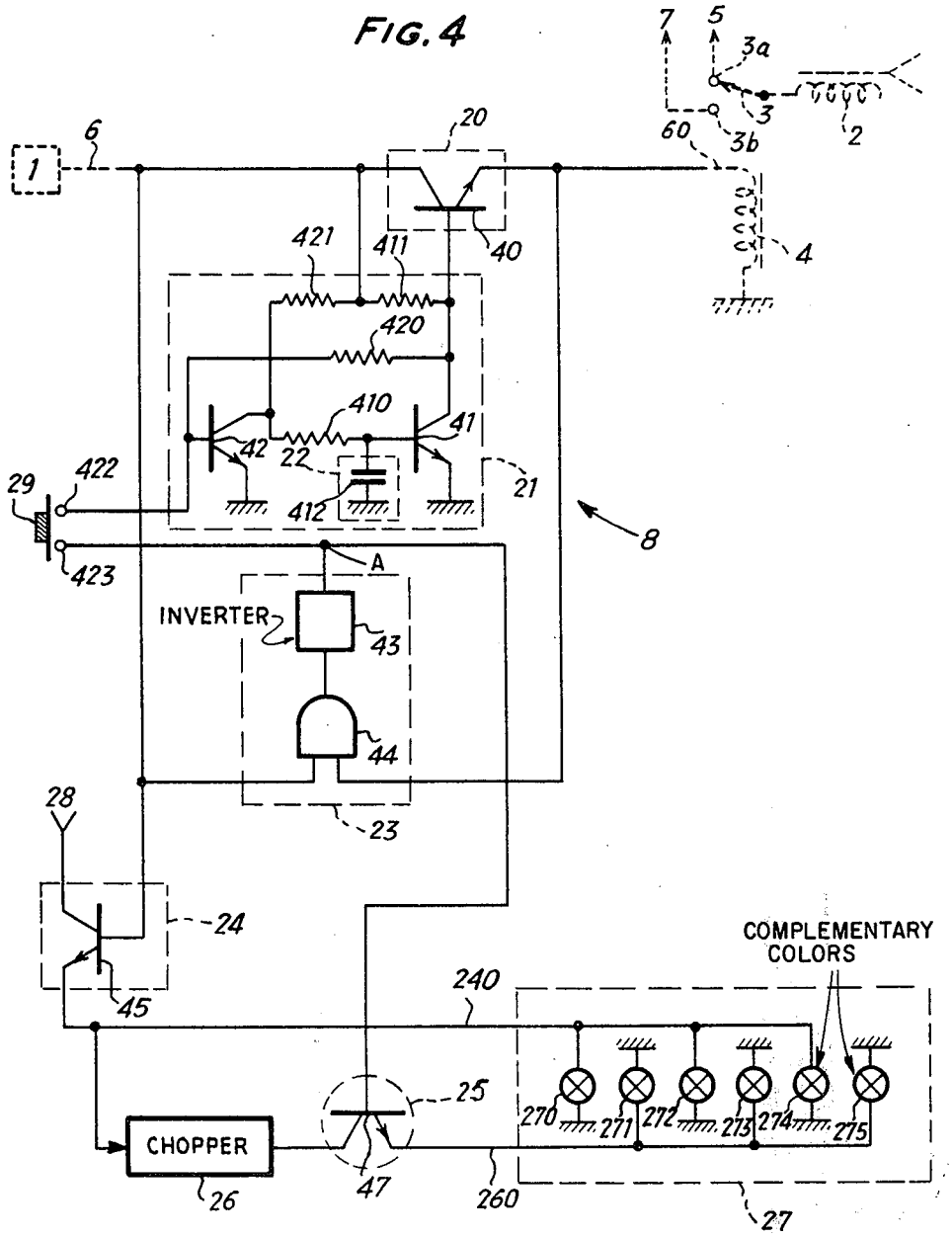
FIG. 4 is a circuit diagram of a modified audibility controller of the general type shown in FIG. 3.

FIG. 4 shows details of the several components illustrated in block form in FIG. 3.

As shown in this figure switch 20 includes a transistor 40, storage circuit 21 is a bistable assembly with transistors 41 and 42, and circuit 22 comprises a capacitor 412.

When signals appear on conductor 6 from section 1, the base of transistor 41 is grounded by the discharged capacitor 412. Transistor 41 does not conduct and its collector is therefore maintained at the potential (here assumed to be positive) of conductor 6 via a resistor 411.

The same positive potential is applied to the base of transistor 42 via a resistor 420. This transistor therefore conducts and at its collector a to a potential comes close to that of its emitter, which is grounded.

The potential of transistor 42 is applied via a resistor 410 to the base of transistor 41, which remains in the nonconductive state. The positive collector potential of transistor 41 is also applied to the base of transistor 40 which conducts and establishes a connection between leads 6 and 60, thus allowing relay 4 to be energized. Consequently, as soon as the receiver section 1 is operative after a pause in the reception of special message signals, the assembly reverts to its original state in which conductors 6 and 60 are interconnected.

Circuit 23 is a NAND gate, shown to comprise an AND gate 44 in cascade with an inverter stage 43. When gate 44 receives from leads 6 and 60 a positive signal of logical value 1, it conducts and grounds a junction A in the output of circuit 43.

The current passing along conductor 6 is also transmitted to the base of a transistor 45, included in switch 24, whose collector is connected to the positive pole of the voltage source 28. Since the polarity of conductor 6 is assumed to be positive, transistor 45 conducts and the positive voltage from source 28 is transmitted by line 240 to an array of lamps 270, 272, 274 forming part of indicator panel 27.

The voltage on lead 240 is also applied to the chopper 26 which, however, is ineffectual at this time since switch 25 is open. This switch comprises a transistor 47 whose collector is tied to the output of the conventional chopper and whose base is at the potential existing at point A; the lighting of the first illuminating array consisting of lamps 270, 272, 274, interleaved with the lamps 271, 273, 275 of the second illuminating array, indicates that section 1 has an output.

If, by means of pushbutton 29, a connection is then established between a pair of terminals 422 and 423 respectively tied to the base of transistor 42 and to junction A. The potential of that base, previously equaling that of conductor 6 connected to it via resistors 420 and 411, thus charges from positive to zero whereby transistor 42 no longer conducts and the voltage of its collector, now equaling that of conductor 6, capacitor 412 via resistor 410 and biases the base of transistor 41 to saturate same, making its collector potential very close to that of its emitter, i.e. ground. This ground potential is transmitted to the base of transistor 40 which therefore ceases to conduct.

It will be apparent that the switchover from one bistable condition of circuit 21 to the other, i.e. between saturation of transistor 41 and that of transistor 42, occurs with a certain delay determined by the time constant of R/C network 410, 412. The condenser 412 stabilizes the storage circuit 21 by insuring, on the one hand, that transistor 41 remains conductive to block the series transistor 40 in circuit breaker 20 during short-term interruption of signal emission from receiver section 1 and, on the other hand, that transistor 41 is cut off upon resumption of such signal emission after a prolonged pause.

Thus, by pressing pushbutton 29 in the saturated state of transistor 42, the user can interrupt the audible reproduction of the special messages from receiver section 1 and reverse the changeover switch 3 to restore communication between loudspeaker 2 and the normal program section 5 of the car radio or other apparatus equipped with the system of FIG. 4. Upon such reversal, AND gate 44 receives a logical 1 from conductor 6, which is still energized by signals from section 1, and a logical 0 from the disconnected extension 60 thereof. This gate therefore produces at its output a logical 0 which inverter 43 converts into a logic 1. The potential of point A is now positive.

As a result of this switchover, the base of transistor 47 is driven positive and the transistor conducts to energize an array of lamps 271, 273, 275 at the frequency of the chopped current from circuit 26, indicating in this way that the special message from equipment 1 is present, but for the moment is not being heard.

If complementary colors are used for the lamps in arrays 270, 272, 274 and 271, 273, 275, the illuminated panel will change color at the frequency of the chopped current from circuit 26.

If the user wishes to return to listening to the special message from section 1, assuming the latter is still operating, it is merely necessary for him to press pushbutton 29 again.

With terminal 423 at the positive potential of point A, this potential is transmitted to the base of transistor 42 via terminal 422. The bistable assembly formed by transistors 41 and 42 reverts to its initial state described above, i.e. transistor 41 is cut off and transistors 42 and 40 conduct. Thus, the special message is heard again over the loudspeaker 2.

It can be seen that when receiver section 1 stops operating, for example when the moving vehicle leaves the effective range of the control post transmitting these signals, pushbutton 29 becomes ineffectual. The absence of positive voltage from conductor 6 blocks transistor 45 and breaks the connection to the source 28, thus de-energizing the luminous arrays in panel 27.

Pushbutton 29 may be replaced by equivalent selector means such as a photoelectric cell responsive to an interruptable beam of incident light beam. Touch-operated devices may also be mentioned by way of example.

While the described audibility-control system is usable especially in the field of road traffic, it is not limited to this particular use.

The visual indicator 27 is capable of giving at least three types of information, namely: an indication that special signals are absent (no illumination), an indication that special signals are present and are being listened to (continuous illumination), and an indication that special signals are present and have been switched out (combination of constant and flashing illumination). Advantageously, the lamps forming the luminous arrays are distinctly colored as discussed above.

It is possible for the lamps forming the light arrays to give continuous illumination of one color and flashing illumination of another, e.g. complementary color.

What is claimed is:

1. In a radio receiver having a first section for picking up special messages and a second section for picking up a normal radio program, electroacoustic transducer means for audibly reproducing information represented by incoming electromagnetic signals, and changeover means with a first position and a second position for connecting said transducer means to said first and said second section, respectively, the combination therewith of sensing means connected to said first section for detecting the presence of incoming special message signals, and indicator means independent of said transducer means controlled by said sensing means and by said changeover means for revealing the arrival of said special message signals in said second position of said changeover means.

2. The combination defined in claim 1 wherein said indicator means comprises a luminous display.

3. The combination defined in claim 2 wherein said indicator means further comprises a chopping circuit for operating said luminous display in a flashing manner.

4. The combination defined in claim 1 wherein said indicator means comprises luminous display means, first switching means connected to said first section for energizing said display means in the presence of said special message signals, and second switching means connected to said sensing means for establishing two distinctively different modes of operation of said display means, determined by the position of said changeover means, upon energization thereof by said first switching means.

5. The combination defined in claim 4 wherein said indicator means further comprises a chopping circuit in series with said second switching means for establishing one of said modes of operation.

6. The combination defined in claim 5 wherein said display means comprises first illuminating means connected to said first switching means and second illuminating means connected to said second switching means via said chopping means.

7. The combination defined in claim 5 wherein said first and second illuminating means comprise differently colored lamps.

8. In a radio receiver having a first section for picking up special messages and a second section for picking up a normal radio program, electroacoustic transducer means for audibly reproducing information represented by incoming electromagnetic signals, changeover means with a first position and a second position for connecting said transducer means to said first and said second section, respectively, and signal-responsive switch means connected to said first section for automatically shifting said changeover means from said second position to said first position upon the beginning arrival of special message signals, the combination therewith of sensing means connected to said first section for generating an output signal upon detecting the presence of said special message signals, and manual selector means for placing said changeover means in either of said positions thereof, said manual selector means being effective in the presence of said output signal to shift said changeover means from said first to said second position and concurrently therewith to temporarily deactivate said signal-responsive switch means in the presence of said special message signals.

9. The combination defined in claim 8, further comprising indicator means independent of said transducer means controlled by said sensing means for revealing the arrival of said special message signals in said second position of said changeover means.

10. The combination defined in claim 9 wherein said indicator means comprises first and second illuminating means with distinctively different modes of operation, first switching means connected to said first section for energizing said first illuminating means in the presence of said special message signals, and second switching means connected to said sensing means for energizing said second illuminating means upon said changeover means occupying said second position in the presence of said special message signals.

11. The combination defined in claim 10 wherein said indicator means further comprises a chopping circuit inserted between said second switching means and said second illuminating means.

12. The combination defined in claim 11 wherein said first and second illuminating means comprise two interleaved arrays of lamps.

13. The combination defined in claim 8 wherein said signal-responsive switch means has an energizing circuit extending from said first section and including a circuit breaker controlled by said selector means for deactivating said signal-responsive switch means.

14. The combination defined in claim 8 wherein said sensing means comprises a voltage comparator with input leads connected across said circuit breaker.

15. The combination defined in claim 14 wherein said voltage comparator comprises a logical NAND gate.

16. The combination defined in claim 14 wherein said voltage comparator has an output terminal developing a first potential upon substantial equality of the voltages on said input leads, indicative of the presence of said special message signals in said energizing circuit, and developing a second potential in the absence of such equality, further comprising a bistable circuit for the control of said circuit breaker, said bistable circuit having an input terminal temporarily connectable by said selector means to said output terminal for reversing the state of conductivity of said bistable circuit.

17. The combination defined in claim 16 wherein said bistable circuit is provided with stabilizing circuitry including and R/C network delaying the effect of a connection of said input terminal to said output terminal.

18. The combination defined in claim 8 wherein said selector means comprises a pushbutton.

19. In a vehicle equipped with a radio receiver, in combination:

a first receiver section for picking up special messages:

a second receiver section for picking up a normal radio program;

electroacoustic transducer means for audibly reproducing information represented by incoming electromagnetic signals;

changeover means with a first position and a second position for connecting said transducer means to said first and said second section, respectively;

sensing means connected to said first section for detecting the presence of incoming special message signals; and indicator means independent of said transducer means controlled by said sensing means and by said changeover means for revealing the arrival of said special message signals in said second position of said changeover means.

* * * * *